US006843480B2

(12) United States Patent
Nelson et al.

(10) Patent No.: US 6,843,480 B2
(45) Date of Patent: Jan. 18, 2005

(54) SEAL RING FOR WELL COMPLETION TOOLS

(75) Inventors: John Alan Nelson, Cypress, TX (US); John Vince Salerni, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 10/213,863

(22) Filed: Aug. 7, 2002

(65) Prior Publication Data

US 2004/0026866 A1 Feb. 12, 2004

(51) Int. Cl.[7] ..... E21B 33/128

(52) U.S. Cl. ..... 277/338; 277/341; 277/607; 277/624; 277/626; 285/123.12

(58) Field of Search ..... 277/336–8, 340, 277/341, 607, 617, 624, 626, 627; 285/106, 123.12; 166/186, 184

(56) References Cited

U.S. PATENT DOCUMENTS

| | | | | | |
|---|---|---|---|---|---|
| 2,002,122 | A | * | 5/1935 | McWane et al. | 164/111 |
| 2,069,212 | A | * | 2/1937 | Buffington | 277/439 |
| 2,309,446 | A | | 1/1943 | Ekkebus | |
| 2,320,107 | A | | 5/1943 | Speckert | |
| 2,517,290 | A | * | 8/1950 | De Moude et al. | 277/612 |
| 2,722,043 | A | * | 11/1955 | Nenzell | 49/479.1 |
| 2,754,136 | A | * | 7/1956 | Newton | 277/322 |
| 2,791,194 | A | | 5/1957 | Janise | |
| 2,809,130 | A | | 10/1957 | Rappaport | |
| 2,988,148 | A | * | 6/1961 | Conrad et al. | 277/337 |
| 3,191,950 | A | * | 6/1965 | Hiltner | 277/611 |
| 3,195,906 | A | * | 7/1965 | Moyers | 277/611 |
| 3,414,273 | A | * | 12/1968 | Sumner | 277/626 |
| 3,492,026 | A | * | 1/1970 | Ahlstone | 285/18 |
| 3,531,133 | A | * | 9/1970 | Gulick et al. | 277/611 |
| 3,573,872 | A | * | 4/1971 | Sannes | 277/651 |
| 3,871,449 | A | * | 3/1975 | Ahlstone | 166/183 |
| 4,131,287 | A | | 12/1978 | Gunderson et al. | |
| 4,178,020 | A | * | 12/1979 | Dopyera | 285/18 |
| 4,324,422 | A | * | 4/1982 | Rains et al. | 285/123.12 |
| 4,337,956 | A | | 7/1982 | Hopper | |
| 4,521,040 | A | * | 6/1985 | Slyker et al. | 285/123.12 |
| 4,630,833 | A | * | 12/1986 | Boyle et al. | 277/500 |
| 4,671,352 | A | | 6/1987 | Magee, Jr. et al. | |
| 4,714,111 | A | * | 12/1987 | Brammer | 166/182 |
| 4,809,989 | A | * | 3/1989 | Kernal | 277/337 |
| 4,815,770 | A | * | 3/1989 | Hyne et al. | 285/123.12 |
| 4,827,834 | A | | 5/1989 | Leigh-Monstevens | |
| 4,842,061 | A | * | 6/1989 | Nobileau | 166/115 |
| 4,858,690 | A | | 8/1989 | Rebardi et al. | |
| 4,900,067 | A | * | 2/1990 | Jansen et al. | 285/123.12 |
| 4,935,084 | A | | 6/1990 | Rego | |
| 4,968,184 | A | | 11/1990 | Reid | |
| 4,995,464 | A | * | 2/1991 | Watkins et al. | 166/382 |
| 5,060,724 | A | * | 10/1991 | Brammer et al. | 166/208 |
| 5,068,074 | A | | 11/1991 | Rego | |
| 5,137,087 | A | | 8/1992 | Szarka et al. | |
| 5,333,688 | A | * | 8/1994 | Jones et al. | 166/278 |
| 5,341,880 | A | * | 8/1994 | Thorstensen et al. | 166/278 |
| 5,464,063 | A | * | 11/1995 | Boehm, Jr. | 166/382 |
| 5,467,822 | A | * | 11/1995 | Zwart | 166/179 |
| 5,511,620 | A | * | 4/1996 | Baugh et al. | 166/387 |
| 5,542,475 | A | * | 8/1996 | Turner et al. | 166/387 |
| 5,579,842 | A | * | 12/1996 | Riley | 166/250.01 |
| 5,584,488 | A | | 12/1996 | Lembcke | |
| 5,957,204 | A | | 9/1999 | Chatterji et al. | |
| 2001/0045700 | A1 | | 11/2001 | Russell | |

FOREIGN PATENT DOCUMENTS

| | | |
|---|---|---|
| EP | 0964 191 A2 | 12/1999 |
| FR | 2672 097 | 1/1991 |

* cited by examiner

*Primary Examiner*—Alison K. Pickard
(74) *Attorney, Agent, or Firm*—Madan, Mossman & Sriram, PC

(57) ABSTRACT

A high pressure ring seal for tube assembly joints provides structural foundation ring having inside and outside circumferential channels between end rims. The channels and rims are separated by a web of integral ring material. This web is perforated by a plurality of apertures. As an integral coating within both channels and integrally tied through the web apertures is a coating of polymer sealant material. Inside and outside faces of the sealant are pressure equalized by vent apertures through the web apertures.

32 Claims, 3 Drawing Sheets

SEAL RING FOR WELL COMPLETION TOOLS

BACKGROUND OF THE INVENTION

1. Field of the Invention

The present invention relates to earth boring arts and devices for subterranean well completion. In particular, the invention relates to fluid sealing elements for axially translated tubular members that are dynamically operative in chemically hostile, high pressure environments such as cross-over flow assemblies.

2. Description of Related Art

Deep subterranean wells are drilled to recover economically valuable fluids such as natural gas and crude petroleum. In many cases, these wells penetrate geologic zones that confine extreme pressure. When encountered, high pressure must be controlled and maintained. For those reasons, high pressure zones are often isolated by packers and casing liners.

Completion of a well for extended fluid production includes many complex procedures. Among these procedures are formation fracturing, gravel packing and cementing. To execute some of these procedures, it is necessary to redirect the normal course of well working fluid. Well working fluids are generally characterized as "mud" but the term expansively includes water, solvents and particulate mixtures for gravel and sand packing. The normal working fluid circulation route in a well starts from the fluid pumps at the surface. The fluid pump discharge is piped into the well tubing string (or drill pipe) and down the central flow bore of the tubing string. The working fluid exits the flow bore at the bottom of the tubing string or at a desired intermediate point through selectively opened apertures in the tubing wall.

In many cases, an annular space exists between the tubing string and the well bore or casing wall. This annular space, characterized as the annulus, provides a channel for the working fluid return flow stream to the well surface and back to fluid reservoir pits or the pump suction.

There are many circumstances in the life of a well that require fluid and pressure isolation of an axial section of the annulus from an adjacent section. For example, it may be desired to isolate the bottomhole pressure from the upper annulus and at the same time, shield a bottomhole production zone from contamination fluid entering the well bore from a higher strata. This desire is satisfied by means of a "packer" that provides an annular barrier between the tubing string and the well wall. Difficulty arises, however, when other well operations below the packer require fluid circulation. The packer blocks the working fluid return flow channel. This difficulty is overcome by means of a "cross-over assembly" which provides an additional flow annulus between the tubing string inner flow bore and an inner bore of the packer. Depending on the cross-over assembly setting, fluid may be pumped down the tubing flow bore into the annulus below the packer. From the annulus below the packer, the well working fluid (mud) may be channeled into the cross-over inner annulus to by-pass the packer and back into the well annulus above the packer.

In another typical example, working fluid may be pumped down the tubing flow bore to a cross-over point below the packer but above the tubing string bottom end. At the cross-over point, the working fluid is channeled out into the lower well annulus below the packer. The working fluid flows down the lower annulus to the bottom end of the tubing string to enter the tubing string flow bore. Working fluid flow from the bottom end of the tubing string is up the flow bore to the cross-over point where the flow enters the cross-over inner annulus. Further upward fluid flow proceeds along the inner annulus to a point above the packer where the flow is channeled out into the upper well annulus to complete the return flow circuit.

Typically, a cross-over assembly comprises an outer tube to which the packer is secured. Below the packer, the outer tube may have apertures through the tube wall. These outer tube apertures are internally isolated by reduced I.D. ring sections having smoothly finished sealing surfaces along the I.D. wall face of a ring section. A cross-over tube secured to the end of a tubing work string, has an O.D. less than the sealing surface of the outer tube ring section I.D. O.D. ring seals along the length of the cross-over tube are dimensioned to cooperate with the sealing surface I.D. Depending on the relative axial alignment between the cross-over pipe and the outer packer tube, controlled circulation flow past the packer is achieved while maintaining a pressure differential across the packer and ring seals.

Due to the hydrostatic head and bottom hole temperature of certain wells, this pressure differential across the packer and ring seals is considerable and imposes great pressure loads against the seals between the cross-over pipe and the sealing surfaces in the outer packer tube. These hydrostatic pressure and geothermal stresses may be compounded by an extremely hostile chemical environment. For example, a well may be treated with amine corrosion inhibitors to reduce the corrosive deterioration of the casing and production tube. Compounds such as zinc bromide may be used for well pressure containment and control. Additionally, inhibitor and containment compounds may be used in mixed combination. Both such well treatment compounds have aggressive consequences on the elastomers and polymers normally used to seal the tubular interface of completion and production equipment.

To resist these highly reactive well treatment compounds, special purpose sealant compounds such as fluoroelastomers based upon alternating copolymers of tetrafluoroethylene and propylene (AFLAS®) have been developed. However, these AFLAS® types of sealing compounds do not bond (Vulcanize) well with metallic substructures. When the high pressure load on a seal is abruptly released over the seal, such as when the cross-over tube is axially shifted, a resulting rush of fluid across a seal tends to dislodge and damage the seal.

It is an objective of the present invention, therefore, to provide reliable bore sealing elements for substantially coaxial tube members.

Another object of the invention is a highly improved cross-over assembly seal.

SUMMARY OF THE INVENTION

The present cross-over tube seal comprises a metallic ring member having inside and outside diameter channels between opposite end shoulders. A plurality of radial apertures distributed about the ring circumference penetrate the ring wall between the inside and outside channels.

The desired, chemically resistant elastomer such as AFLAS® is coated into both channels with a seal band proximate of the opposite end shoulders. Between the seal bands, elastomer surfaces, both inside and outside, are formed to a shallow concavity.

Additional to traditional surface bonding such as Vulcanizing, the inner and outer coatings of elastomer are unitized through the ring apertures by an integral plug of elastomer. Preferably, each aperture plug is perforated by a smaller aperture for equalizing the pressure differential between the inside and outside cylindrical surfaces of the ring.

The present sealing ring is positioned in the cross-over tube assembly in the traditional assembly position between adjacent cross-over tube mandrels. Threaded joint assembly of the adjacent joints axially confines the ring between opposing joint shoulders. Inside diameter sealing bands bear a static seal against a cylindrical seal surface on the mandrel pin joint. Outside sealing bands cooperate with the spaced bore surfaces on the cross-over outer tube to provide pressure isolated cells along the cross-over assembly length.

BRIEF DESCRIPTION OF DRAWINGS

For a thorough understanding of the present invention, reference is made to the following detailed description of the preferred embodiments, taken in conjunction with the accompanying drawings in which like reference characters designate like or similar elements throughout the several figures of the drawing.

DESCRIPTION OF PREFERRED EMBODIMENTS

Figure 1:
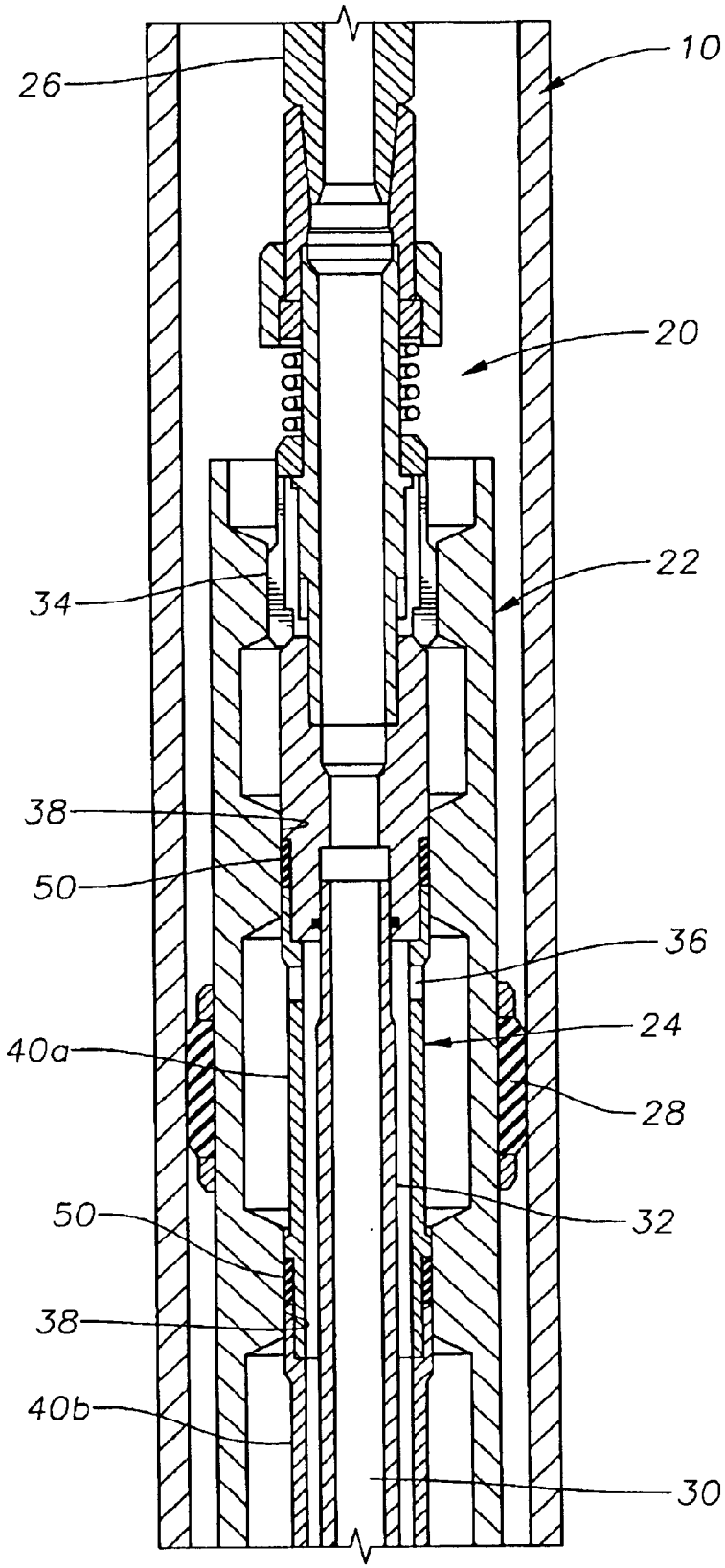
FIG. 1 is a partially sectioned wellbore and cross-over assembly.

For environmental orientation, a representative application of the present invention is illustrated by the FIG. 1 sectional schematic of a well casing 10. Within the well casing is a cross-over assembly 20 having an outer tube 22 and an inner, cross-over tube 24. The cross-over tube 24 is secured by a threaded pipe joint to the lower end of a tubing string 26. The outer tube 22 is secured to the inside wall of the casing 10 by means of one of more packers 28. The outer tube 22 and cross-over tube 24 are joined by an assembly thread 34 for downhole placement as a unit. After the packer 28 is located at the desired position, the packer and associated slip (not shown) is set against the inside wall surface of the casing 10. This packer and slip setting secures the outer tube 22 to the casing 10. Subsequently, the work string 26 is rotated to disassemble the cross-over tube 24 from the anchored and sealed outer tube.

The cross-over tube 24 also includes a central flow bore 30 and an inner annular flow channel 32. The inner flow channel 32 is open by aperture 36 through the cross-over tube wall.

Figure 2:
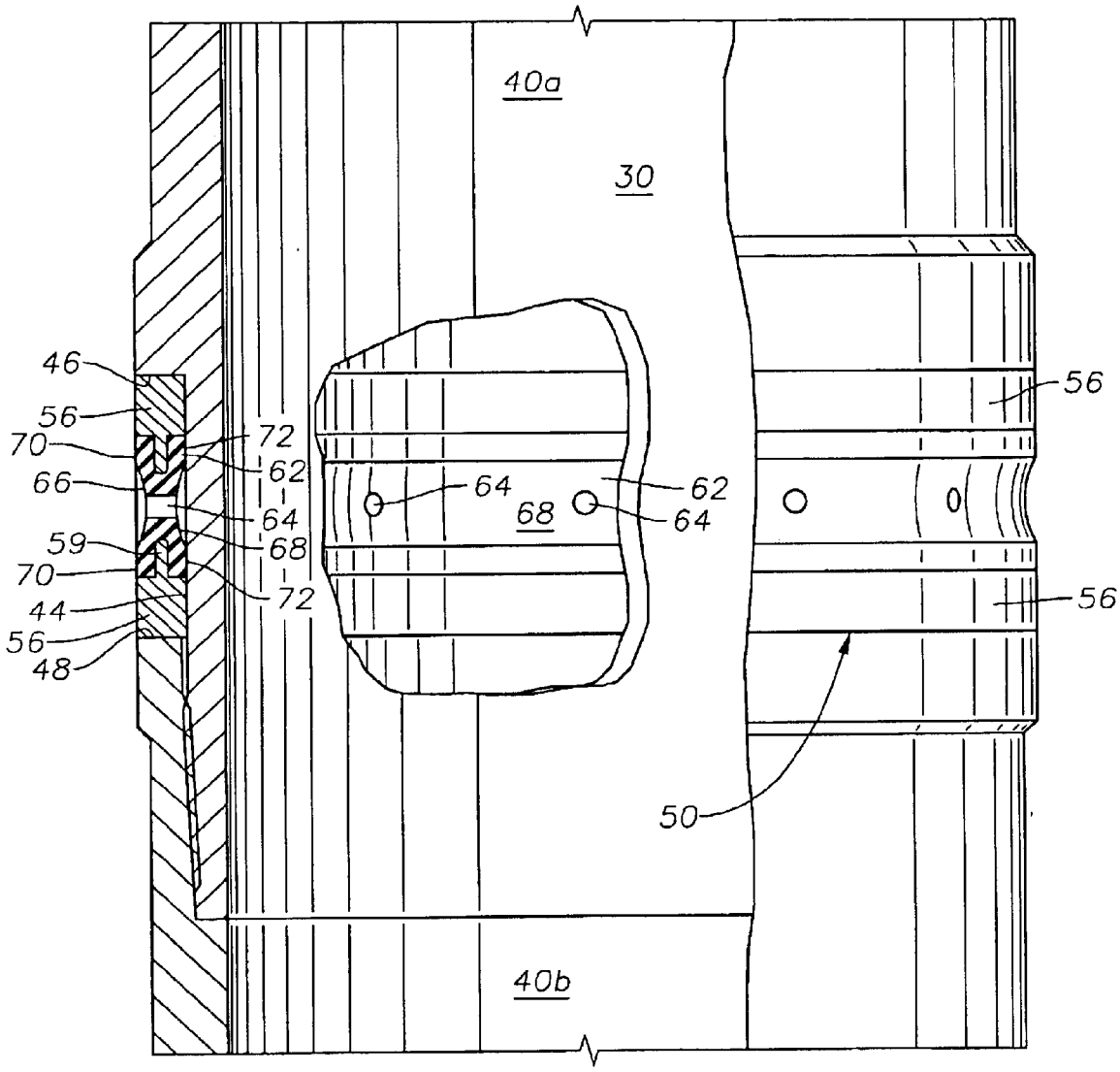
FIG. 2 is a partially sectioned pipe joint sealed by the present invention.

The length of the cross-over tube 24 comprises a serial assembly of numerous flow mandrels 40*a*, 40*b*, etc. joined by threaded seal joints 42. With respect to FIG. 2, the "pin" (male) portion of a joint 40*a* comprises a sealing sleeve 44 between the thread 42 and a compression shoulder 46. The "box" (female) portion of a joint 40*b* comprises a compression shoulder 48 about the distal end of the joint portion. The joint elements and features are dimensioned to confine a seal ring 50 between the shoulders 46 and 48 when the thread joint is closed. The inside seals of the ring 50 provide a fluid pressure sealing interface with the sealing sleeve surface 44 and thereby, a fluid pressure seal of the threaded assembly 42 between pressure differentials respective to the mandrel flow bore 30 and the external mandrel environment.

Outside seals on the ring 50 interface with bore seal surfaces 38 on the outer cross-over assembly tube 22. Longitudinal dimensioning between the bore seal surfaces and the separation between ring seals 50 is coordinated to accomplish respective cross-over tool functions by each of several axial alignments between the outer tube 22 and the cross-over tube 24.

Figure 3:
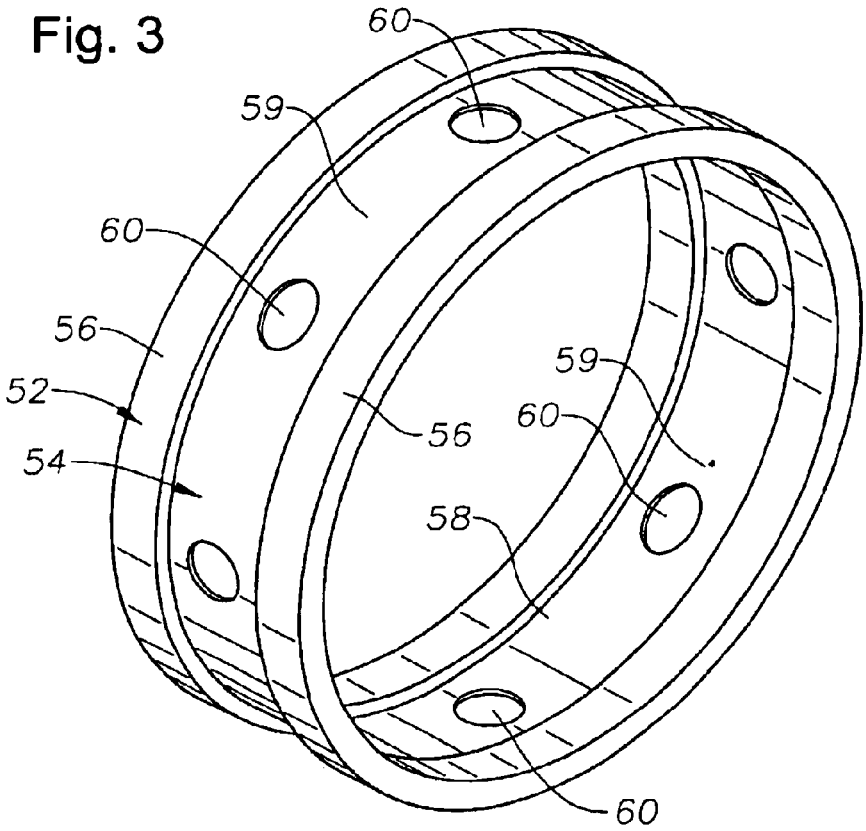
FIG. 3 is an isometric view of the present invention foundation ring.
Figure 4:
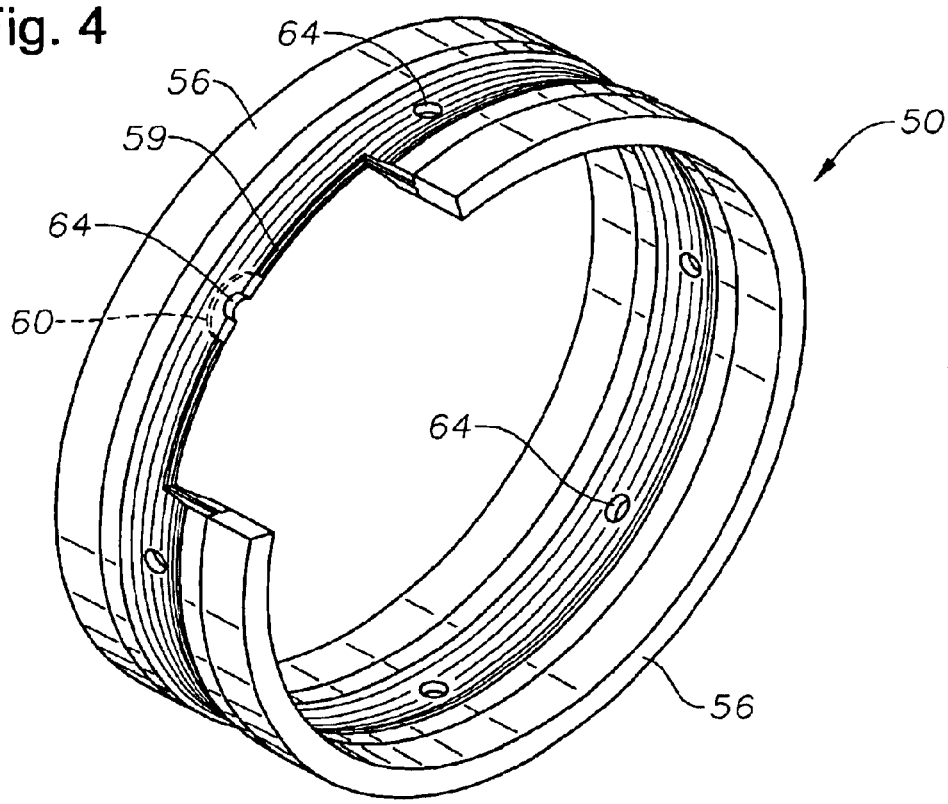
FIG. 4 is an isometric view of the present invention showing a partial section removal.

With respect to FIGS. 3 and 4, construction of a ring seal 50 includes a structural foundation ring 52 fabricated from a suitable material. The foundation ring material should be selected with due consideration of the intended operational environment. In most well operations, a mild steel alloy is suitable. Wells treated with highly reactive components such as amines and bromides may require a stainless steel alloy or Inconel. Other applications may allow non-ferrous metals or dense polymers as the material source of the foundation ring.

Assuming an original material shape in the form of a cylinder, an outside channel 54 is formed into the outer ring perimeter between opposite end rims 56. Similarly, an inside channel 58 is formed between the opposite end rims 56. A cylindrical web 59 of foundation material remains between the inside and outside channels. Linking the inside and outside channels are a plurality of apertures 60 through the web 59 distributed substantially uniformly about the ring perimeter.

Cast, for example, on and into the channels 54 and 58 and the apertures 60, as an integral coating, is a suitable sealing polymer such as the fluoroelastomer AFLAS®. Whether cast or machined, a smaller aperture 64 perforates the polymer web within each of the foundation web apertures 60. The polymer seal coating is further formed with outside and inside cavities, 66 and 68, respectively. The outside cavity 66 is formed between a pair of outside seal bands 70 whereas the inside cavity is formed between a pair of inside seal bands 72.

The cavities 66 and 68 are functional voids in the invention design to distribute the pressure differential load on the seal substantially uniformly across the transverse plane of the seal (pressure force vectors parallel with the wellbore axis). Although an arcuate void shape 66 and 68 is illustrated as the preferred embodiment, it will be understood that other void shapes such as a box or channel may be used to accommodate seal material movement due to pressure distortion and temperature expansion. Ideally, the pressure differential load imposed on that seal band directly engaged with the highest pressure environment is distributed across the full annulus of the low pressure side of the seal whereby the unsupported ridge of low pressure sealing band carries only a fractional portion of the full pressure differential load.

Dimensionally, the O.D. of the outside seal bands 70 is greater than the O.D. of the end rims 56. Similarly, the I.D. of the inside seal bands 72 is less than the I.D. of the end rims 56. It is the outside seal bands 70 that make interface contact with the seal bore faces 38 on the outer assembly tube 22. It is the inside seal bands 72 that make interface contact with the seal sleeve surface 44 of the mandrel joint pin.

Those of skill in the art will appreciate the fact that fluid pressures within the cross-over flow bore 30 may be developed in excess of a high formation pressure that is restrained by the packer 28. These high pressures are generated by surface pumps for some well treatment purpose such as chemical fracturing or cementing. A portion of this high flow bore pressure will bleed past the inner seal band 72 into the inside cavity 68. At the same time, a portion of the bottom-hole pressure will bleed past the outer seal bands 70 into the outer cavity 66. When a particular seal 50 is drawn above the uppermost bore seal surface 38, the fluid confined under high pressure in the outside cavity 66 is released abruptly. Although the fluid volume within the outside cavity 66 is small, the escape velocity of such volume over the seal band face is such as may damage or destroy prior art seals. To further resist such decompression destruction, the elastomer sealant of the present invention is vulcanized to the foundation ring to reinforce the mechanical interlock that is inherent with the invention.

The apertures 64 between the inside and outside cavities serve to equalize pressure differentials that would otherwise develop between the opposing surfaces. The aperture vents 64 of the present invention release the inside cavity pressure at the same time as the outside cavity pressure is released.

An alternative embodiment of the invention may take the form of independent rings respective to each of the sealing bands 70/72 whereby an unsealed mating interface is provided between the outside cavity 66 and inside cavity 68. This unsealed interface between separate seal band rings provides the same function as the apertures 64 for venting the inside cavity 68 in the event of sudden pressure changes.

Although the invention has been described in the application environment of a cross-over assembly, those of skill in the art will appreciate the design relevance of this ring seal to many other high pressure, chemically hostile applications such as long term formation fluid production. The design may also be used in many piston/cylinder and rod/tube applications unrelated to subterranean wells.

It should be understood that this description of our preferred embodiment is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A pressure seal ring having an elastomer sealant material coated onto a foundation ring, said sealant material formed to profile materially integral inside and outside diameter seal portions;

said inside diameter seal portion presenting a pair of inside diameter seal bands that are integrally contiguous with one another and separated by an inside chamber space; and said outside diameter seal portion presenting a pair of outside diameter seal bands that are integrally contiguous with one another and separated by an outside chamber space; and, wherein the foundation ring has a plurality of apertures therethrough and the sealant material is perforated through at least one of the apertures.

2. A pressure seal ring as described by claim 1 wherein said inside and outside chamber spaces are mutually vented.

3. A pressure seal ring as described by claim 1 wherein said sealant material is formed into respective inside and outside diameter channels in said foundation ring.

4. A pressure seal ring as described by claim 1 wherein said sealant material is a fluoroelastomer.

5. A well tubing seal for isolating a formation fluid flow stream in a tubing flow bore from a non-formation wellbore fluid environment, said seal comprising:

(a) a cylindrical foundation ring having inside and outside perimeter channels;

(b) a sealant material coating into said inside and outside channels (c) a pair of outside perimeter seal bands integrally profiled from said sealant material; and, (d) a pair of inside perimeter seal bands integrally profiled from said sealant material, said sealant material of said inside and outside seal being integrally continuous; and, (e) wherein the foundation ring has a plurality of apertures therethrough and the sealant material is perforated through at least one of the apertures.

6. A well tubing seal as described by claim 5 wherein said sealant material is fluoroelastomer.

7. A well tubing seal as described by claim 6 wherein said sealant material coating into said inside and outside channels is bonded to said foundation ring.

8. A well tubing seal as described by claim 5 wherein said inside and outside perimeter channels are mutually vented.

9. A tubing seal ring comprising:

(a) a substantially cylindrical foundation ring having inside and outside perimeter channels between end ridges, said ridges being integrally linked by a substantially cylindrical web between said channels;

(b) a plurality of first apertures through said web and distributed thereabout;

(c) a sealant material coating of said channels having integral continuity through said web apertures between inside and outside channels; and, (d) a plurality of second apertures through said first apertures.

10. A seal ring as described by claim 9 wherein said sealant material is profiled adjacent said end ridges with perimeter bands whereby an O.D. of said bands is greater than an O.D. of said end ridges and an I.D. of said bands is less than an I.D. of said end ridges.

11. A seal ring as described by claim 10 wherein sealant material coating of said channels between said bands is formed to an arc profile.

12. A seal ring as described by claim 10 wherein sealant material coating of said channels between said bands is formed to a shallow concavity.

13. A seal ring as described by claim 9 wherein said sealant material is fluoroelastomer.

14. A seal ring as described by claim 13 wherein said fluoroelastomer is based upon an alternating copolymer of tetrafluoroethylene and propylene.

15. A seal ring as described by claim 14 wherein said fluoroelastomer is bonded to said foundation ring.

16. A cross-over tool for subterranean well management, said cross-over tool having a plurality of tubing joints that are pressure sealed by sealing rings, one tube of a joint having a substantially cylindrical seal surface for engaging a ring sealing band, said sealing rings comprising a substantially cylindrical unit having a circumferential web linking respective end ribs to delineate respective I.D. and O.D. channels, said web having a plurality of apertures distributed thereabout, a polymeric coating of said I.D. and O.D. channels, said coating respective to said I.D. and O.D. channels being integrally linked through said apertures, and said polymeric coating being perforated through said apertures.

17. A cross-over tool as described by claim 16 wherein said polymeric coating is bonded to said web.

18. A cross-over tool as described by claim 16 having I.D. sealing bands formed in said coating adjacent respective end ribs, said I.D. sealing bands having an I.D. less than an I.D. of said end ribs for engaging said cylindrical seal surface.

19. A cross-over tool as described by claim 18 having a shallow concavity between respective sealing bands.

20. A cross-over tool as described by claim 18 having an arced profile between respective sealing bands.

21. A cross-over tool as described by claim 18 having O.D. sealing bands formed in said coating adjacent respective end ribs, said O.D. sealing bands having an O.D. greater than an O.D. of said end ribs for engaging a cooperative sealing surface.

22. A cross-over tool as described by claim 21 having a shallow concavity between respective sealing bands.

23. A cross-over tool as described by claim 21 having an arced profile between said O.D. sealing bands.

24. A cross-over tool as described by claim 16 wherein said polymeric coating is a fluoroelastomer.

25. A cross-over tool as described by claim 24 wherein said fluoroelastomer is an alternating copolymer of tetrafluoroethylene and propylene.

26. A pressure seal ring comprising:

a foundation ring having a plurality of apertures disposed radially therethrough;

an elastomer sealant material coated onto a foundation ring said sealant material formed to profile materially integral inside and outside diameter seal portions; and the sealant material being radially perforated through at least one of said apertures.

27. The pressure seal ring of claim 26 wherein the inside diameter seal portion of the sealant material is profiled to present a plurality of seal bands that are integrally contiguous with one another and separated by a chamber space.

28. The pressure seal ring of claim 26 wherein the outside diameter seal portion of the sealant material is profiled to present a plurality of seal bands that are integrally contiguous with one another and separated by a chamber space.

29. The pressure seal ring of claim 26 wherein the foundation ring comprises a pair of end ridges that are interconnected by a substantially cylindrical web, said plurality of apertures being disposed though the web.

30. The pressure seal ring of claim 29 wherein inside and outside perimeter channels are defined upon the web between the end ridges.

31. A cross-over tool for subterranean well management, said cross-over tool comprising:

a plurality of tubing joints that are pressure sealed by sealing rings;

at least one of said tubing joints having a substantially cylindrical seal surface for engaging a ring sealing band;

said sealing rings each comprising:

a) an elastomer sealant material coated onto a foundation ring, said sealant material formed to profile materially integral inside and outside diameter seal portions;

b) said inside diameter seal portion presenting a pair of inside diameter seal bands for engagement of a seal surface of a tubing joint, the seal bands being integrally contiguous with one another and separated by an inside chamber space;

c) said outside diameter seal portion presenting a pair of outside diameter seal bands that are integrally contiguous with one another and separated by an outside chamber space; and d) wherein the foundation ring has a plurality of apertures therethrough and the sealant material is perforated through at least one of the apertures.

32. The cross-over tool of claim 31 wherein the inside and outside chamber spaced are mutually vented.

* * * * *